US007742793B2

(12) United States Patent
Ye

(10) Patent No.: US 7,742,793 B2
(45) Date of Patent: Jun. 22, 2010

(54) MICROSTRIP FILTER INCLUDING RESONATORS HAVING ENDS AT DIFFERENT COUPLING DISTANCES

(75) Inventor: Shen Ye, Cupertino, CA (US)

(73) Assignee: Conductus, Inc., Santa Barbara, CA (US)

( * ) Notice: Subject to any disclaimer, the term of this patent is extended or adjusted under 35 U.S.C. 154(b) by 0 days.

(21) Appl. No.: 10/507,066

(22) PCT Filed: Mar. 10, 2003

(86) PCT No.: PCT/US03/07139

§ 371 (c)(1),
(2), (4) Date: Aug. 29, 2005

(87) PCT Pub. No.: WO03/077352

PCT Pub. Date: Sep. 18, 2003

(65) Prior Publication Data

US 2006/0025309 A1 Feb. 2, 2006

Related U.S. Application Data

(60) Provisional application No. 60/362,596, filed on Mar. 8, 2002.

(51) Int. Cl.
*H01P 1/203* (2006.01)
*H01B 12/02* (2006.01)

(52) U.S. Cl. ..... 505/210; 333/99 S; 333/204; 333/219

(58) Field of Classification Search ..... 333/99 S, 333/204, 219; 505/210, 866
See application file for complete search history.

(56) References Cited

U.S. PATENT DOCUMENTS

| | | | | |
|---|---|---|---|---|
| 4,488,130 | A * | 12/1984 | Young et al. | 333/203 |
| 4,992,759 | A | 2/1991 | Giraudeau et al. | |
| 5,055,809 | A * | 10/1991 | Sagawa et al. | 333/219 |
| 5,105,173 | A * | 4/1992 | Itou | 333/204 |
| 5,351,020 | A | 9/1994 | Okamura et al. | |
| 6,833,773 | B1 * | 12/2004 | Tsukamoto et al. | 333/134 |
| 6,897,745 | B2 * | 5/2005 | Aiga et al. | 333/204 |

FOREIGN PATENT DOCUMENTS

| | | |
|---|---|---|
| EP | 05299914 | * 11/1993 |
| WO | WO 98/00880 | 1/1998 |

OTHER PUBLICATIONS

XP-000732019 "Theory and Experiment ofNovel Microstrip Slow-Wave Open-Loop Resonator Filters", Hong et al.; IEEE Transations of Microwave Theory and Techniques, vol. 45, No. 12, Dec. 1997, pp. 2358-2365.

TH2D-6 "Novel Approach for Narrowband Superconducting Filters", M. Reppel et al., 1999 IEEE MTT-S Digest, pp. 1563-1566.

* cited by examiner

*Primary Examiner*—Benny T. Lee
(74) *Attorney, Agent, or Firm*—Merchant & Gould P.C.

(57) ABSTRACT

A method and apparatus to provide appropriate coupling between resonators in an HTS microstrip filter are disclosed. Primary and secondary couplings between a pair of resonators are utilized. With a given spacing, the primary coupling is fixed, while the secondary coupling can have different magnitude. In addition, the secondary coupling can have the same phase or opposite phase as the primary coupling. With different combinations, large or small bandwidth filters can be made without very small or very large spacing between resonators. The same cross coupling layout configuration may be designed to achieve either positive or negative results.

20 Claims, 7 Drawing Sheets

MICROSTRIP FILTER INCLUDING RESONATORS HAVING ENDS AT DIFFERENT COUPLING DISTANCES

This application is being filed as a PCT International patent application in the name of Conductus, Inc., a U.S. national corporation, applicant for the designation of all countries except the US, and Shen Ye, a resident of the U.S. and a citizen of Canada, applicant for the designation of the U.S. only, and claims priority to U.S. application Ser. No. 60/362,596, filed Mar. 8, 2002.

FIELD OF THE INVENTION

This invention generally relates to the field of filters. More particularly, it relates to the field of microwave band filters. Still more particularly, it relates to the field of very-narrow band, microstrip, superconductive band-pass filters.

BACKGROUND OF INVENTION

Narrowband filters are particularly useful in the communications industry and particularly for wireless communications systems which utilize microwave signals. At times, wireless communications have two or more service providers operating on separate bands within the same geographical area. In such instances, it is essential that the signals from one provider do not interfere with the signals of the other provider(s). At the same time, the signal throughput within the allocated frequency range should have a very small loss.

Within a single provider's allocated frequency, it is desirable for the communication system 20 to be able to handle multiple signals. Several such systems are available, including frequency division multiple access (FDMA), time division multiple access (TDMA), code division multiple access (CDMA), and broad-band CDMA (b-CDMA). Providers using the first two methods of multiple access need filters to divide their allocated frequencies in the multiple bands. Alternatively, CDMA operators might also gain an advantage from dividing the frequency range into bands. In such cases, the narrower the bandwidth of the filter, the closer together one may place the channels. Thus, efforts have been previously made to construct very narrow bandpass filters, preferably with a fractional-band width of less than 0.05%.

An additional consideration for electrical signal filters is overall size. For example, with the development of wireless communication technology, the cell size (e.g., the area within which a single base station operates) will get much smaller—perhaps covering only a block or even a building. As a result, base station providers will need to buy or lease space for the stations. Since each station requires many separate filters, the size of the filter becomes increasingly important in such an environment. It is, therefore, desirable to minimize filter size while realizing a filter with very narrow fractional-bandwidth and high quality factor Q.

Microstrip filters have the advantages of small size and low manufacturing costs. However, microstrip filters constructed of conventional metals suffer a much higher loss than other technologies (e.g., such as waveguide, dielectric resonator, combline, etc.), and especially in very narrow bandwidth filters. With high-temperature superconductive ("HTS") thin film technology, microstrip filters using HTS materials can achieve extremely low loss and superior performance. Therefore, use of HTS microstrip filters is particularly useful for very-narrow band filters.

Using microstrip technology for narrow bandpass filter design, the spacing between the resonators usually determines the amount of coupling between the resonators. As the spacing increases, the coupling decreases and, therefore, the bandwidth becomes narrower. For very-narrow band filters, the spacing between resonators can be quite substantial. Techniques have been developed in the prior art to reduce the required spacing. For example, in a lumped element type resonator environment (see Zhang, et al. U.S. patent application Ser. No. 08/706,974, which issued on Aug. 20, 2002 as U.S. Pat. No. 6,438,394, and Ye, U.S. patent application Ser. No. 09/699,783, which issued on Oct. 14, 2008 as U.S. Pat. No. 7,437,187); and in a distributed element type resonator environment (see Tsuzuki, et. al., U.S. Provisional Application 60/298,339), all assigned to the assignee of the current invention. These techniques have been shown to be successful in effectively reducing the spacing between resonators for very-narrow band filters in the respective environments. However, the techniques may not be effective (using the same structure), when the required bandwidth of the filter becomes large. Where a broader bandwidth is desired, closer spacing between resonators is required. In some cases, the spacing may become too small from manufacturability point of view, i.e., lithography, sensitivity, yield, etc.

It is also known that to reach higher filter rejection performance while maintaining a minimal number of resonators, couplings between non-adjacent resonators can be applied to realize transmission zeros. For example, see MICROSTRIP CROSS-COUPLING CONTROL APPARATUS AND METHOD, filed Apr. 2, 1999, and receiving Ser. No. 09/285,350, which issued on Mar. 4, 2003 as U.S. Pat. No. 6,529,350, which application is commonly assigned to the assignee of the present application. Such application being incorporated herein and made a part hereof by reference. These transmission zeros can be placed at strategic locations to achieve optimal filter performance. Besides actual cross coupling value, the precise transmission zero location depends an the phase of these crass couplings, i.e., whether it is positive cross coupling or negative cross coupling. Therefore, crass coupling can be utilized to improve filter performance.

Therefore, there exists a need for a very-narrow bandwidth filter having the convenient fabrication advantage of microstrip filters while achieving, in a small filter, the appropriate coupling. Further, the appropriate coupling should take advantage of cross-coupling between non-adjacent resonators to introduce transmission zeros which provide an optimized transmission response of the filter.

SUMMARY OF THE INVENTION

The present invention provides for a method and apparatus to provide appropriate coupling between resonators in an HTS microstrip filter. The present invention uses the concept of primary and secondary couplings between a pair of resonators. With a given spacing, the primary coupling is fixed, while the secondary coupling can have different magnitude. In addition, the secondary coupling can have the same phase or opposite phase as the primary coupling. With different combinations, large or small bandwidth filters can be made without very small or very large spacing between adjacent resonators. The same cross coupling layout configuration may be designed to achieve either positive or negative results.

One feature of the present invention is that the resonator is designed to have both ends accessible from one side of the resonator. Because of the current flow in a resonator, orienting the two ends of the resonator toward the same side allows the primary and secondary coupling to be added or subtracted from one another through relatively simple design changes. Another feature includes arranging and configuring a first end of the resonator with a substantially larger interface to the adjacent resonator than the second end of the resonator. The primary coupling between the resonator is generally associated with the first larger interface end of the resonator to the adjacent resonator. The secondary coupling is generally associated with the second smaller interface end of the resonator to the adjacent resonator, but the secondary coupling may also be assisted by an additional coupling strip.

Therefore, according to one aspect of the invention, there is provided a resonator apparatus, of the type used in filters for an electrical signal, comprising: a first resonator device, having a first end and a second end; a second resonator device; and wherein the first end and the second end are arranged and configured to lie on the same side of the first resonator and proximate the second resonator, and wherein the distance of the first end from the second resonator creates a primary coupling between the first and second resonators, and the distance and length of the second end creates a secondary coupling between the first and second resonators, whereby the overall distance of the first and second resonators from one another may be optimized by controlling either the primary or secondary coupling.

According to a further aspect of the invention, there is provided one or more of the following additional features in accordance with the preceding paragraph: wherein the first and second resonator devices are constructed in an HTS microstrip configuration; wherein the first end is arranged and configured to provide a substantially larger interface to the second resonator than the second end; further comprising a coupling strip which couples the second end to the second resonator; and/or wherein the micro-strip topology includes a dielectric substrate of either MgO, $LaAlO_3$, $Al_2O_3$, or YSZ.

According to another aspect of the invention, there is provided a filter for electrical signals, comprising: a plurality of resonators, at least one resonator having a first end and a second end; and the first end and the second end being arranged and configured to lie on the same side of the at least one first resonator and proximate a second resonator, and wherein the distance of the first end from the second resonator creates a primary coupling between the at least first and second resonators, and the distance and length of the second end creates a secondary coupling between the at least first and second resonators, whereby the overall distance of the at least first and second resonators from one another may be optimized by controlling either the primary or secondary coupling.

According to still another aspect of the invention, there is provided a filter for electrical signals, comprising: a first resonator device; a second resonator device; a coupling strip between the first and second resonators; and the first resonator device and the second resonator device having a primary coupling and a secondary coupling between the first and second resonators, wherein the overall distance of the first and second resonators from one another establishes the primary coupling and the distance between the coupling strip and the overlap with the first and second resonators establishes the secondary coupling, whereby the distances between adjacent resonators may be optimized by controlling either the primary or secondary coupling.

In an additional aspect of the invention, there is provided a method of controlling coupling in an electric signal filter, having a first and second resonator and a coupling strip, comprising the steps of: determining the primary coupling between the first and second resonators based on the desired distance between the first and second resonators; determining the desired secondary coupling in order to arrive at the total desired coupling between the first and second resonators; and determining the distances and lengths of the coupling strip from the first and second resonators to achieve the determined secondary coupling F2, where F2 is a function of S2*a*, S2*b*, L2*a* and L2*b*, and S2*a* is defined as the distance between the coupling strip and the first resonator, L2*a* is the length of the coupling strip which lies adjacent the first resonator, S2*b* is the distance between the coupling strip and the second resonator, and L2*b* is the length of the coupling strip which lies adjacent the second resonator, the primary coupling F1, where F1 is a function of S1, and S1 is defined as the distance between the first resonator and the second resonator, wherein the total coupling between the first resonator and the second resonator, F, is defined by:

$$F=F1(S1)+F2(S2a, S2b, L2a, L2b).$$

In a further aspect of the invention in accordance with the preceding paragraph, there is provided the additional step of locating at least one non-adjacent resonator device and a coupling strip between the first resonator and the at least one non-adjacent resonator device.

These and other advantages and features which characterize the present invention are pointed out with particularity in the claims annexed hereto and forming a further part hereof. However, for a better understanding of the invention, the advantages and objects attained by its use, reference should be made to the drawings which form a further part hereof, and to the accompanying descriptive matter, in which there is illustrated and described preferred embodiments of the present invention.

BRIEF DESCRIPTION OF THE DRAWINGS

In the Drawings, wherein like reference numerals and letters indicate corresponding 20 elements throughout the several views.

DETAILED DESCRIPTION DETAILED DESCRIPTION OF THE PREFERRED EMBODIMENTS

The principles of this invention apply to the filtering of electrical signals. The preferred apparatus and method of the present invention provides for control of placement of transmission zeroes to provide greater skirt rejection and optimize the transmission response curve of the filter. Means are provided to increase or decrease the coupling between resonator elements in order to control the zeroes. A preferred use of the present invention is in communication systems and more specifically in wireless communications systems. However, such use is only illustrative of the manners in which filters constructed in accordance with the principles of the present invention may be employed.

The present invention provides for a method and apparatus to provide appropriate coupling between resonators in an HTS microstrip filter. The present invention utilizes primary and secondary couplings between a pair of resonators. With a given spacing, the primary coupling is fixed, while the secondary coupling can have different magnitude. In addition, the secondary coupling can have the same phase or opposite phase as the primary coupling. With different combinations, large or small bandwidth filters can be made without very small or very large spacing between resonators. The same cross coupling layout configuration may be designed to achieve either positive or negative results.

Figure 1A:
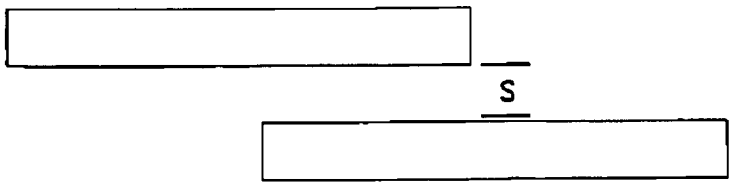
FIG. 1A (PRIOR ART)
FIGS. 1*a*, 1*b* and 1*c* show three different conventional microstrip filter sections wherein the coupling between the two resonators is determined by the gap size "S".
Figure 1B:
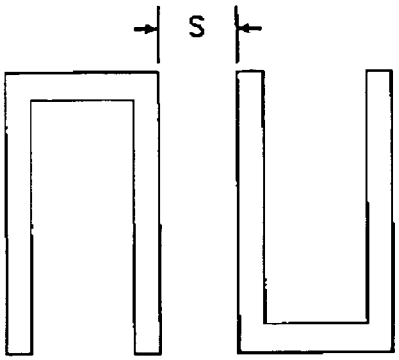
FIG. 1B (PRIOR ART)
Figure 1C:
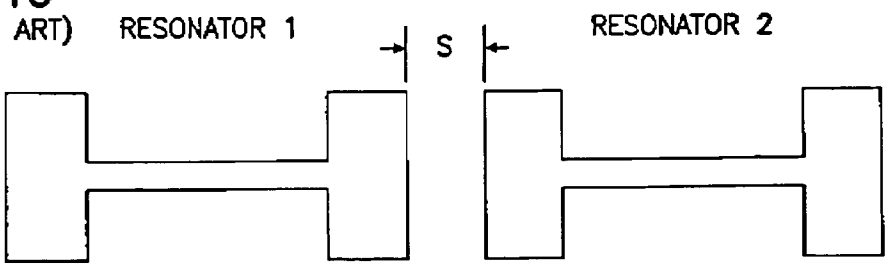
FIG. 1C (PRIOR ART)
Figure 2:
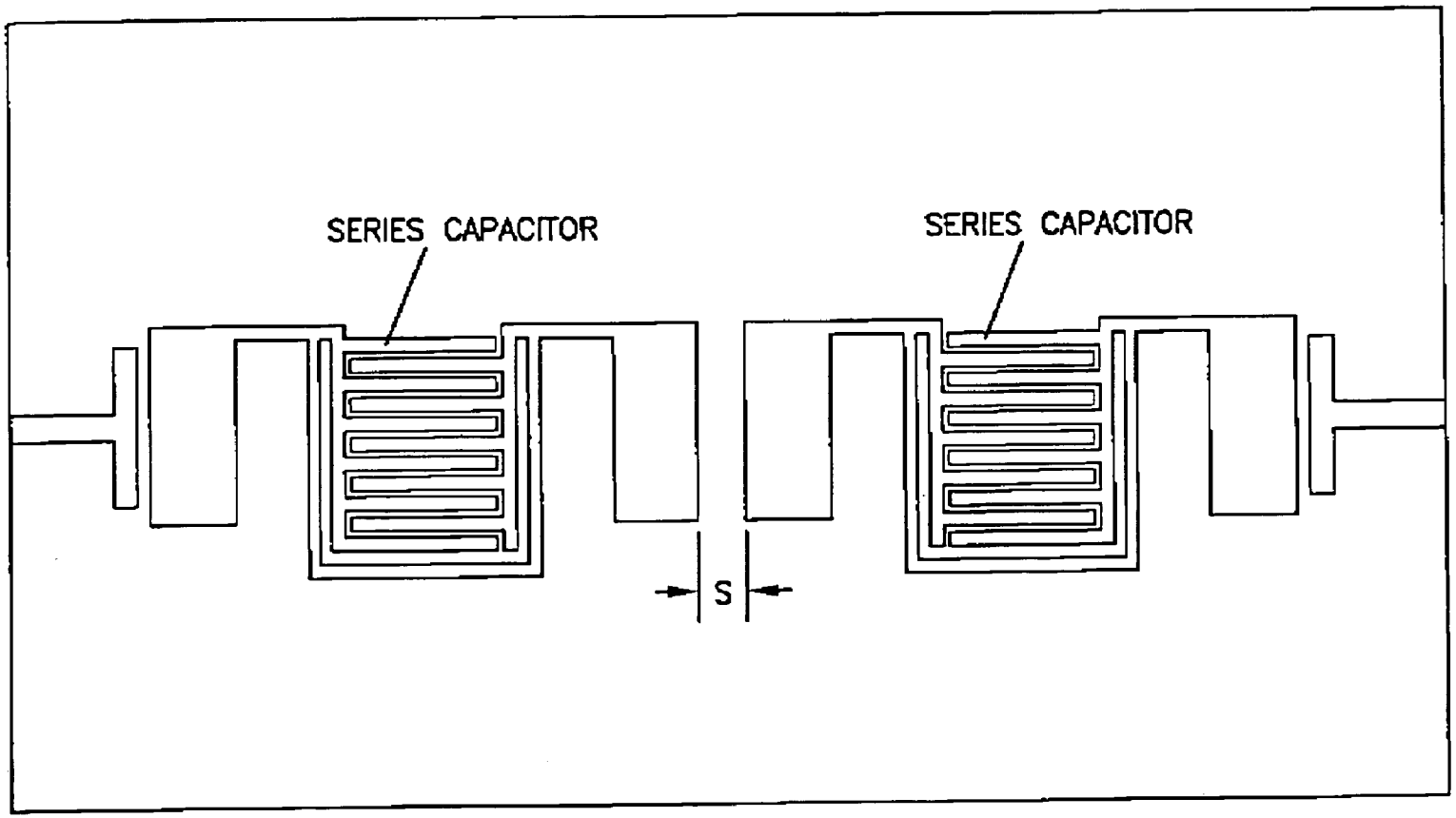
FIG.2 (PRIOR ART)
FIG. 2 shows a microstrip filter section wherein the coupling between the two resonators is determined by the gap size "S".

Turning first to FIGS. 1*a*, 1*b*, and 1*c*, these figures generally illustrate conventional microstrip filter sections wherein the coupling between the two resonators (e.g., Resonator 1, Resonator 2) is determined by the gap size "S". By varying the gap size "S", the coupling increases or decreases and thereby affects the bandwidth. FIG. 2 also illustrates a prior art microstrip filter section. In this figure, the coupling between the two resonators is also determined by the gap size "S". However, the coupling in FIG. 2 differs from the couplings in FIGS. 1*a*, 1*b*, 1*c* since, for the same gap size "S", the amount of coupling between the two resonators can be effectively reduced depending on the value of the series capacitor realized though the long, narrow finger interdigital capacitor form.

Figure 3:
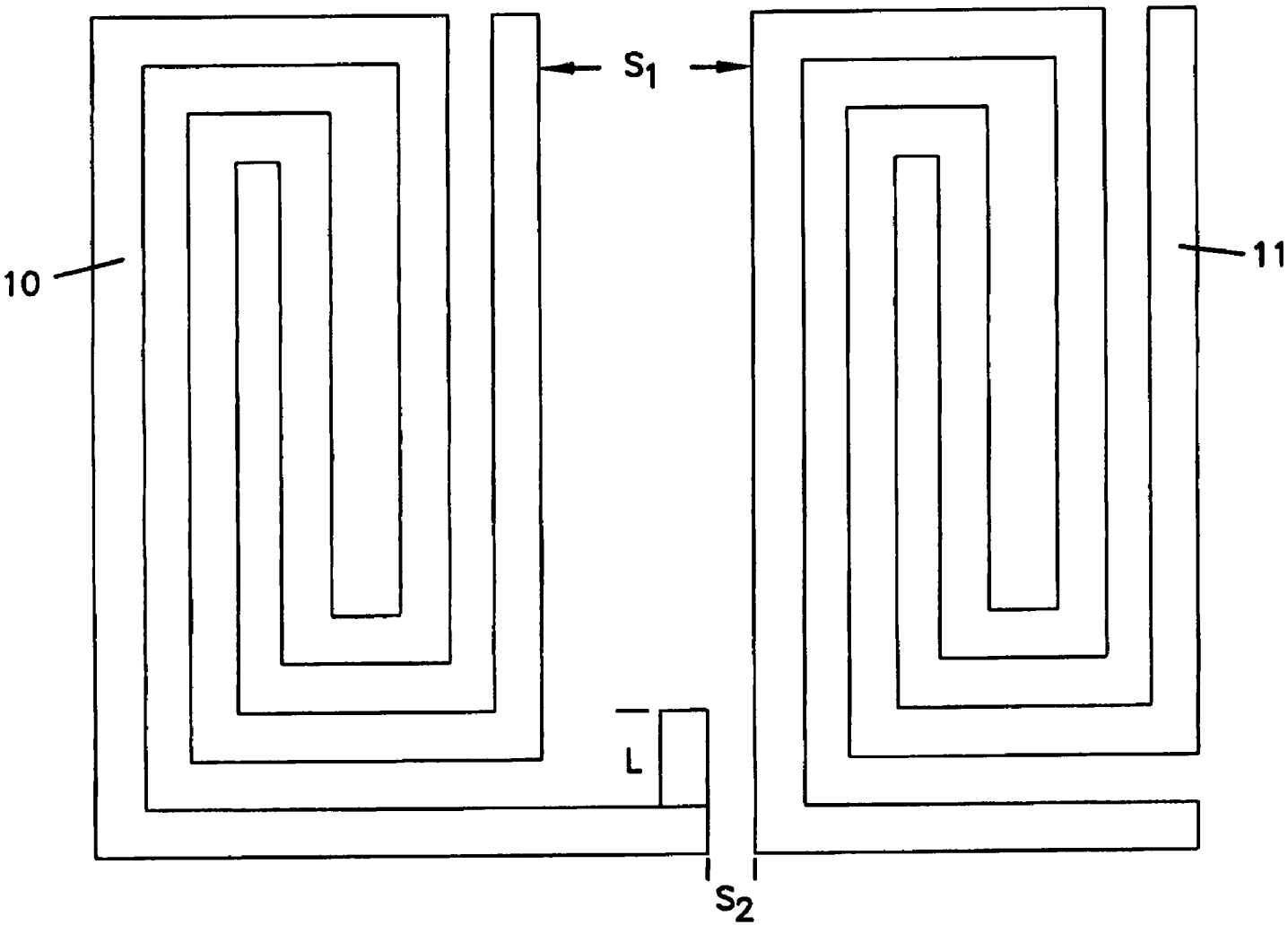
FIG. 3 illustrates schematically the first and second gap sizes S1 and S2 respectively between resonators of an HTS microstrip filter according to the principles of the present invention.

Turning now to FIG. 3, a schematic diagram of two adjacent resonators are illustrated, the resonators being arranged and configured in accordance with the principles of the present invention. The coupling between the first resonator 10 and the second resonator 11 is comprised of two parts. The first part of the coupling, controlled by gap size S1, is the primary coupling. The second part of the coupling, controlled by both gap size S2 and length L, is the secondary coupling. The total coupling between the two resonators is the combination of the first and second parts of the couplings. However, adjusting S1 while keeping S2 and L fixed directly affects the resonator length, i.e., the resonating frequency. And the same applies to adjusting S2 and L.

Figure 4:
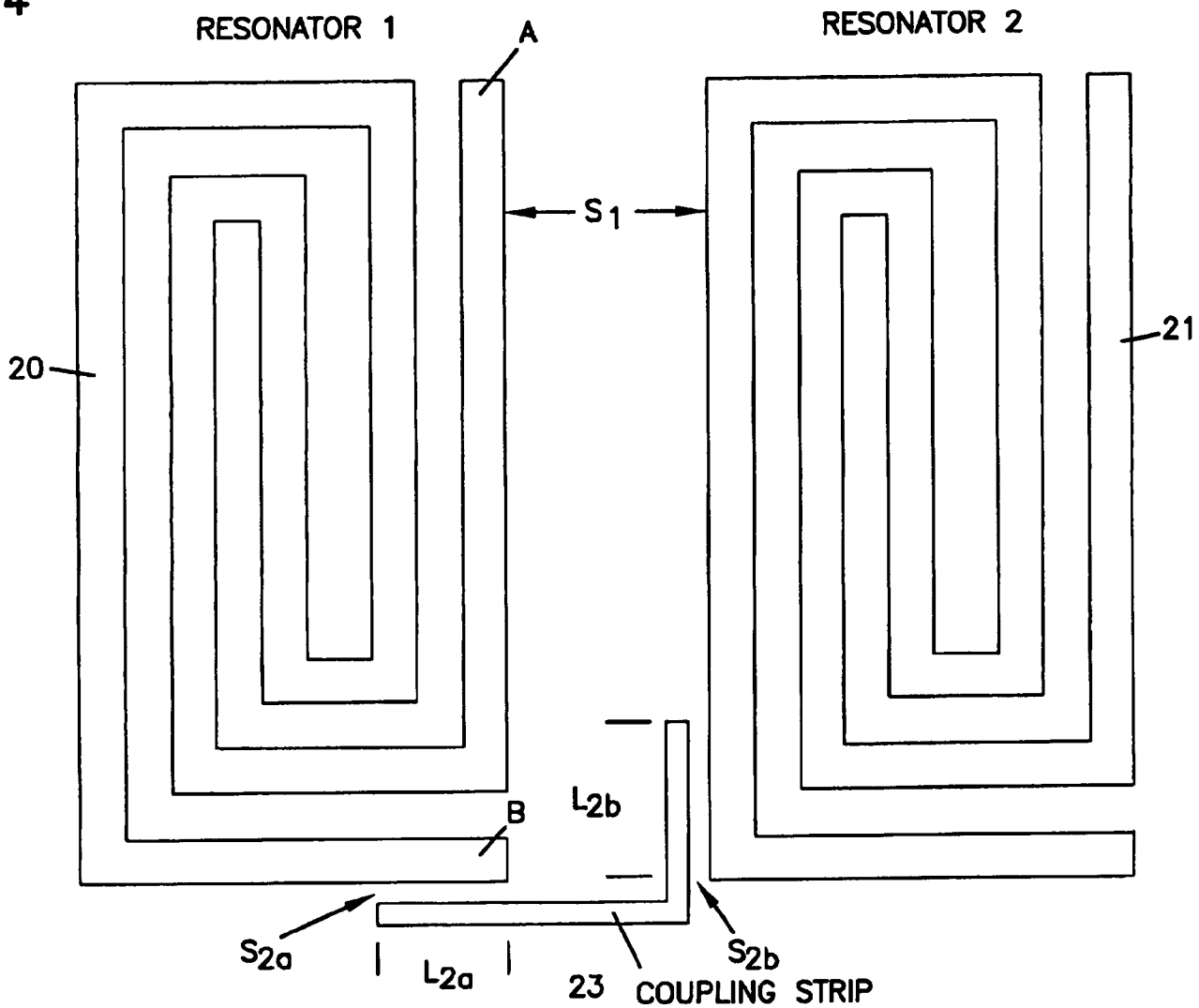
FIG. 4 illustrates schematically an alternative embodiment of the first and second gap sizes S1 and S2 respectively between resonators of an HTS microstrip filter according to the principles of the present invention, wherein the gaps S2*a*, S2*b* and lengths L2*a* and L2*b* can be adjusted to control the amount of secondary coupling.

FIG. 4 illustrates an alternative embodiment in which adjustments of S1 and/or the gaps S2*a*, S2*b* and lengths L2*a*, L2*b* (similar to S2 and L as in FIG. 3) do not affect resonator length (and thereby the resonating frequency). The first and second resonators are identified as 20 and 21 respectively. Similar to FIG. 3, the coupling between the two resonators 20, 21 is comprised of two pans. The first part, the primary coupling, is controlled by S1, the same as the one in FIG. 3. However, the second part, the secondary coupling, is achieved through a coupling strip 23. By adjusting the gaps S2*a*, S2*b* and lengths L2*a* and L2*b*, the amount of secondary coupling can change within a wide range without affecting physical structure of both resonators.

In order to illustrate the considerations associated with designing the primary and secondary coupling for a resonator, FIG. 4 may be used as an example. Without changing the resonators, the primary coupling F1 is a function of S1, and the secondary coupling F2 is a function of S2*a*, S2*b*, L2*a* and L2*b*. The total coupling between Resonator 1 and Resonator 2, F, is then:

$$F=F1(S1)+F2(S2a, S2b, L2a, L2b) \quad (1)$$

As a resonator, the current flow towards the two ends of the resonator is always in opposite directions. For example in FIG. 4, if current is flowing towards A of Resonator 1, current must be flowing out of B of Resonator 1 at the same time. The same applies to the electric charge build-up at both ends. Thus, at any time, A and B will have charges of opposite signs. This is due to the nature of the resonator, in particular, microstrip line resonators.

Therefore, F1(S1) and F2(S2*a*, S2*b*, L2*a*, L2*b*) will have different signs. The total coupling between Resonator 1 and Resonator 2 can have either the same sign as F1 or as F2, depending on the relative magnitude of F1 and F2.

For example, $$F\approx F1(S1), \text{ for } |F2|<<|F1| \quad (2)$$

$$F=0, \text{ for } |F2|=|F1| \quad (3)$$

And $$F=\text{sign}(F2)|F1|, \text{ for } |F2|=2|F1| \quad (4)$$

Recognizing such a wide range of possible couplings between the two resonators, especially the ability to change signs, provides many possibilities for filter design.

For narrow band filter designs, large resonator separations can be avoided by using the coupling cancellation feature of this invention where |F2|=|F1| (e.g., the situation identified in equation (3) above). Further, it is achievable to have a uniform spacing between the resonators by adjusting coupling values identified in equation (1). More specifically, with a fixed S1, i.e., fixed F1, different F can be achieved by changing F2, i.e., S2*a*, S2*b*, L2*a* and L2*b*.

Another important application of this invention is that the coupling sign or phase between the two resonators can be changed without changing the spacing between the two. From equations (2) and (4), when S1 is chosen and assume F1 is positive coupling:

$$F^*=|F1-|F2| \text{ if } F^*>0, \text{ and } F1>|F2| \quad (5)$$

Or $$F^*=-|F2|+F1 \text{ if } F^*<0, \text{ and } |F2|>F1 \quad (6)$$

Where F* is the desired coupling and |F*|<F1.

One of the challenges in filter design is to realize specific positive or negative cross couplings between non-adjacent resonators. With the ability to change coupling signs in accordance with the principles of this invention, the same cross coupling structure between non-adjacent resonators can be easily controlled to be either positive or negative.

Figure 5B:
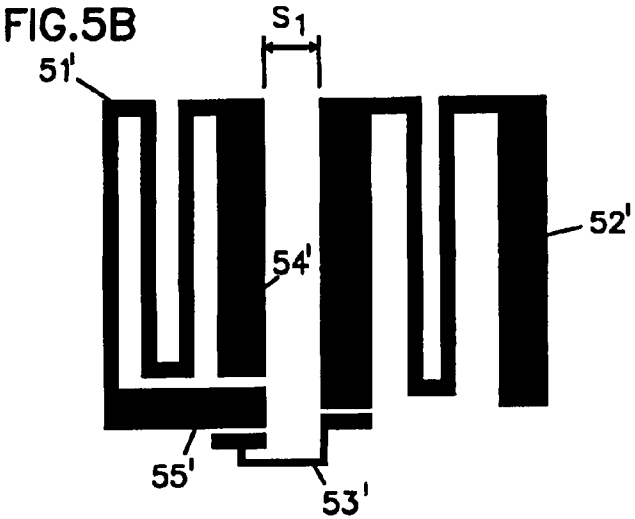
FIGS. 5*a*, 5*b* and 5*c* illustrate a number of variations which can be employed to control the secondary coupling 52 between the resonators.
Figure 5C:
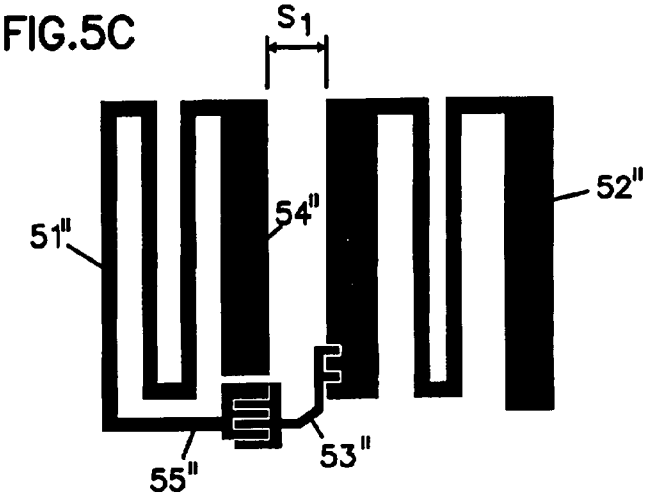
Figure 5A:
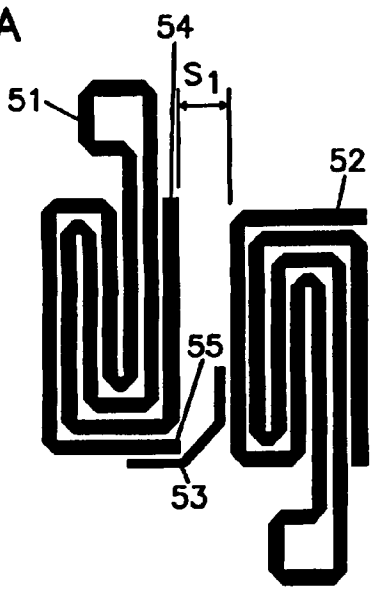

Turning to FIGS. 5*a*, 5*b*, and 5*c*, a number of variations of resonators and a coupling strip utilized to generate the secondary coupling are shown. In FIG. 5*a*, resonator 51 is adjacent resonator 52. The spacing S1 between resonators 51, 52 is identified in FIG. 5*a* and is a fixed spacing. Coupling strip 53 provides secondary coupling as discussed in connection with FIG. 4 (e.g., S2*a*, S2*b*, L2*a* and L2*b*).

The resonators 51 and 52 are arranged and configured to have both ends accessible from one side of the respective resonator. Further, at least one of the resonators, here resonator 51, is arranged and configured to have both ends 54 and 55 oriented toward the other resonator 52. A first end 54 of resonator 51 has a substantially larger interface to the adjacent resonator 52 than the second end 55 of the resonator 52. The primary coupling occurs between the first or larger interface end 54 of the resonator 51 to the adjacent resonator 52. The secondary coupling occurs between the second or smaller interface end 55 of the resonator 51 to the adjacent resonator 52. In this case, the secondary coupling is assisted with coupling strip 53. It will be appreciated that the primary coupling can be either capacitive or inductive, and the same applies for the secondary coupling.

In FIG. 5*b*, resonators 51' and 52' are shown, together with coupling strip 53'. In this figure, resonator 51' includes first end 54' and second end 55' which are located on the same side of the resonator 51' and toward second resonator 52'. However resonator 52' does not include a layout in which the first and second ends of the resonator are arranged on the same side of the resonator 52' (i.e., unlike second resonator 52 illustrated in FIG. 5*a*).

In FIG. 5*c*, resonators 51" and 52" are shown, together with coupling strip 53". In this figure, resonator 51" includes first end 54" and second end 55" which are located on the same side of the resonator 51" and toward second resonator 52". Again, resonator 52" does not include a layout in which the first and second ends of the resonator are arranged on the same side of the resonator 52" (i.e., unlike second resonator 52 illustrated in FIG. 5*a*). Additionally, an interdigitized capacitance arrangement is constructed between the coupling strip 53" and the first 51" and second resonator 52".

Figure 6:
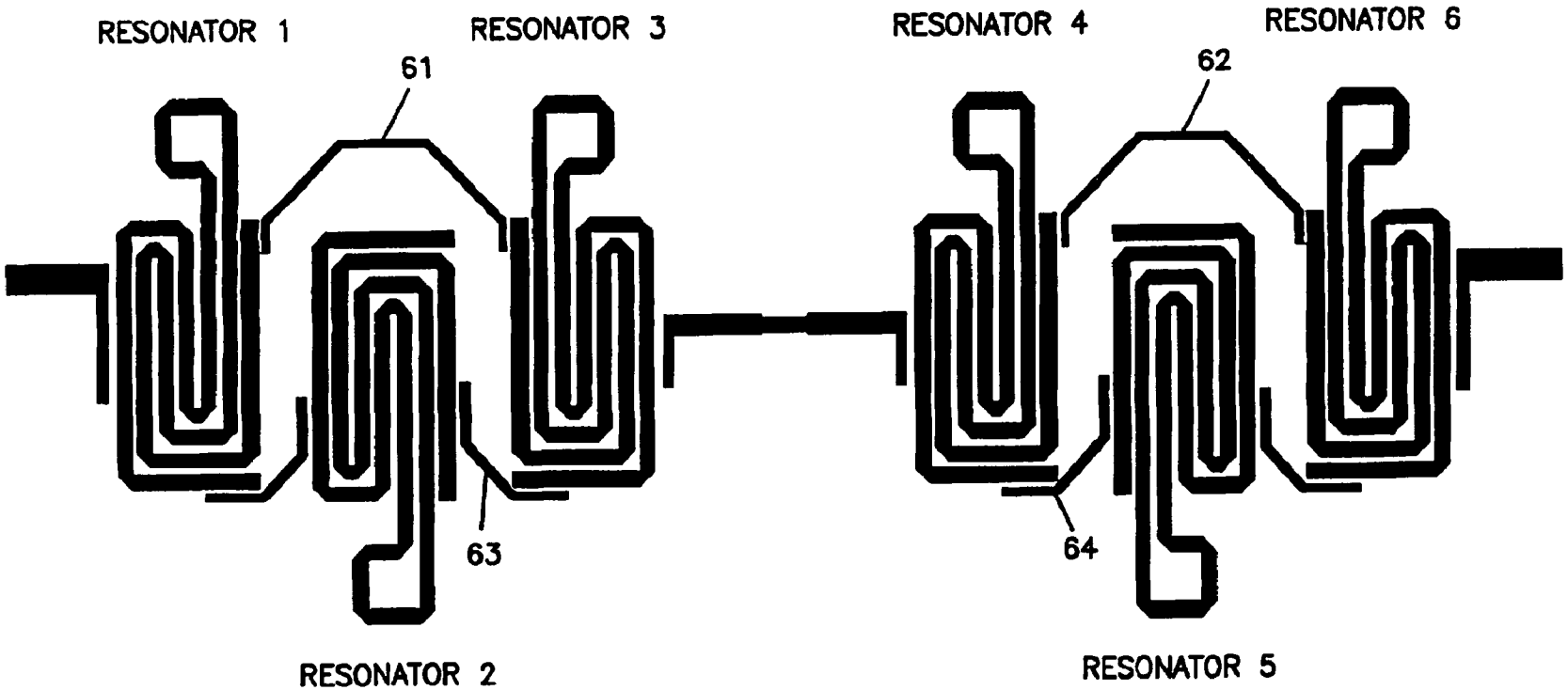
FIG. 6 illustrates a 6-pole filter which employs the principles of the present invention.
Figure 7:
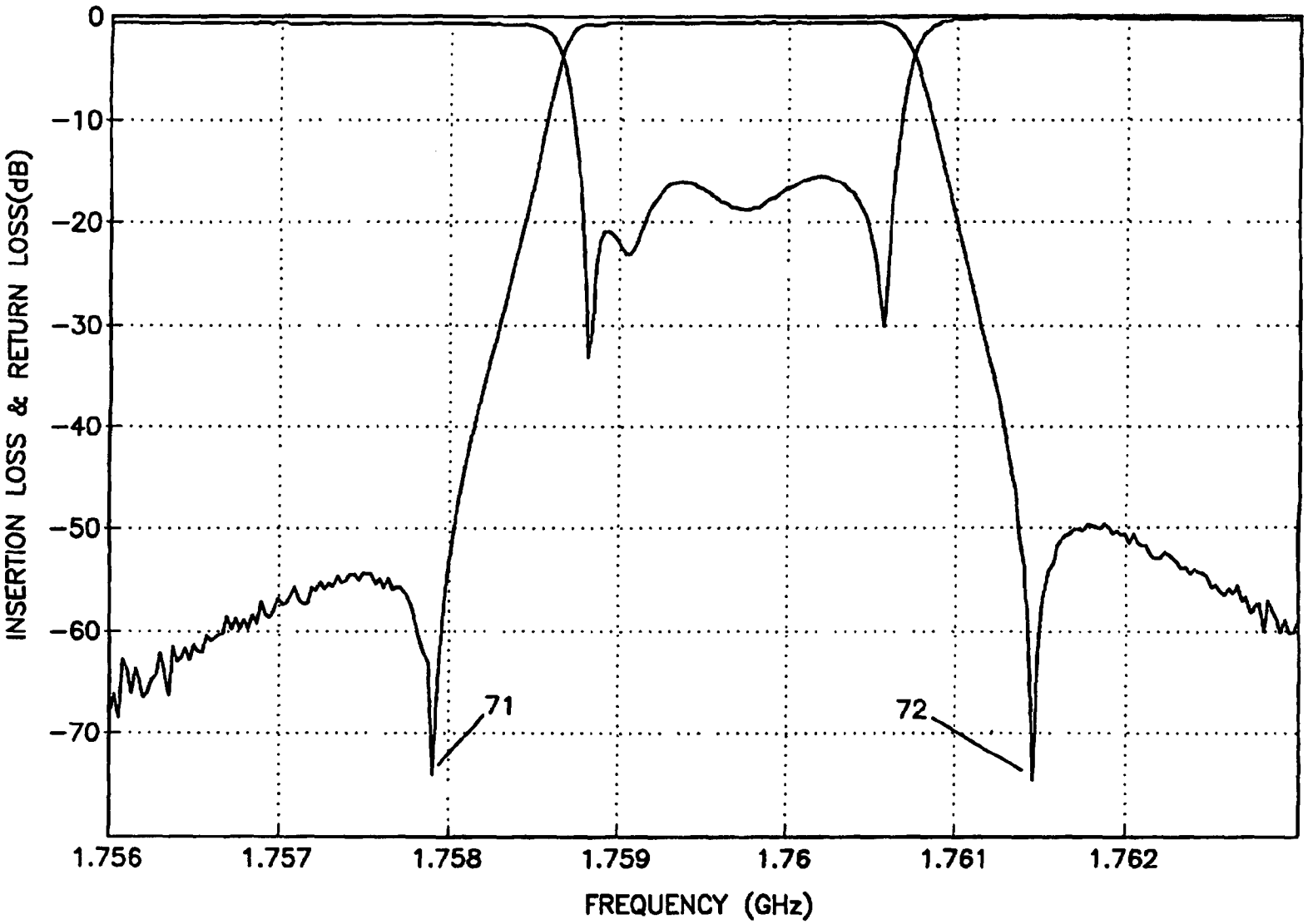
FIG. 7 graphically illustrates the measured response of the 6-pole filter of FIG. 6.

FIG. 6, a 6-pole filter constructed including the principles of the present invention is shown. The cross coupling strip 61 between resonator 1 to resonator 3 and the cross coupling strip 62 between resonator 4 to resonator 6 are of similar type. However, due to different couplings between resonator 2 to resonator 3 from cross coupling strip 63, and between resonator 4 to resonator 5 from cross coupling strip 64, the actual cross couplings from 61 and 62 have opposite signs: one is positive and other is negative. As shown in FIG. 7, transmission zero 71 is achieved by negative cross coupling between resonators 1 and 3 from 61 and 63 in FIG. 6. while transmission zero 72 is achieved by positive cross coupling between resonators 4 and 6 from 62 and 64 in FIG. 6.

As will be apparent to those of skill in the art, the principles of this style of cross coupling may also be used in environments in which other types of filter construction methodologies are employed. For example, the resonators described herein can be used with other types of resonators to achieve desired response shape, filter performance, layout, cost, etc. It will also be appreciated, that the principles of this invention apply to control cross-coupling between non-adjacent resonant devices in order to improve filter performance.

It is to be understood that even though numerous characteristics and advantages of the present invention have been set forth in the foregoing description, together with details of the structure and function of the invention, the disclosure is illustrative only and changes may be made in detail. Other modifications and alterations are well within the knowledge of those skilled in the art and are to be included within the broad scope of the appended claims.

What is claimed is:

1. A resonator apparatus, for use in filters for an electrical signal, comprising:

a. a first resonator device having a first end and a second end, wherein the first end defines a first segment aligned along a first axis and the second end defines a second segment aligned along a second axis, the first axis being non-collinear with the second axis;

b. a second resonator device; and c. wherein the first end and the second end are arranged and configured to lie on the same side of the first resonator and proximate the second resonator, and wherein a first distance of the first end from the second resonator creates a primary coupling between the first and second resonators, and a second distance and a length of the second end creates a secondary coupling between the first and second resonators, wherein the first distance and the second distance do not equal one another, the second end is not physically connected to the second resonator, and the overall distance of the first and second resonators from one another is optimized by independently controlling the primary or secondary coupling.

2. The resonator apparatus of claim 1, wherein the first and second resonator devices are constructed in an HTS microstrip configuration.

3. The resonator apparatus of claim 2, wherein the microstrip configuration includes a dielectric substrate of either MgO, $LaAlO_3$, $Al_2O_3$, or YSZ.

4. The resonator apparatus of claim 1, further comprising at least one non-adjacent resonator device and a coupling strip between the first resonator and the at least one non-adjacent resonator device.

5. The resonator apparatus of claim 1, wherein the first and second resonator devices are located in a common plane and further comprising a coupling strip which couples the second end to the second resonator, the coupling strip being located in the plane.

6. The resonator apparatus of claim 1, wherein the primary coupling can be either capacitive or inductive and the secondary coupling can be either capacitive or inductive.

7. The resonator apparatus of claim 1, wherein the primary coupling can be either capacitive or inductive.

8. The resonator apparatus of claim 1, wherein the secondary coupling can be either capacitive or inductive.

9. A resonator apparatus, for use in filters for an electrical signal, comprising:

a. a first resonator device having a first end and a second end, wherein the first end includes a first segment aligned along a first axis and the second end includes a second segment aligned along a second axis, the first axis aligned generally parallel to and non-collinear with the second axis;

b. a second resonator device, the second resonator not being physically connected to the second end; and c. wherein the first end and the second end are arranged and configured to lie on the same side of the first resonator and proximate the second resonator, and wherein a first distance of the first end from the second resonator creates a primary coupling between the first and second resonators, and a second distance and a length of the second end creates a secondary coupling between the first and second resonators, whereby the overall distance of the first and second resonators from one another is optimized by independently controlling the primary or secondary coupling, wherein the first end is arranged and configured to provide a substantially larger interface to the second resonator than the second end.

10. A filter for electrical signals, comprising:

a. a first resonator device;

b. a second resonator device;

c. a coupling strip overlapping with the first and second resonators, wherein the second end is not physically connected to the coupling strip; and d. the first resonator device and the second resonator device having a primary coupling and a secondary coupling between the first and second resonators, wherein the overall distance of the first and second resonators from one another establishes the primary coupling and the distance between the coupling strip and the overlap with the first and second resonators establishes the secondary coupling, whereby the distances between adjacent resonators is optimized by controlling either the primary or secondary coupling.

11. A filter for electrical signals, comprising:

a. a plurality of resonators, at least one resonator having a first end and a second end connected by a conducting material therebetween, the second end being arranged to overlap at least a portion of the conducting material; and b. the first end and the second end being arranged and configured to lie on the same side of the at least one first resonator and proximate a second resonator, and wherein a first distance of the first end from the second resonator creates a primary coupling between the at least one first resonator and the second resonator, and a second distance and a length of the second end creates a secondary coupling between the at least one first resonator and the second resonator, wherein the first distance and the second distance do not equal one another, the second end is unconnected from the second resonator, and the overall distance of the at least first resonator and the second resonator from one another is optimized by independently controlling the primary or secondary coupling.

12. A method of controlling coupling in an electric signal filter, having a first and second resonator and a coupling strip, comprising the steps of:

a. determining a primary coupling F1 between the first and second resonators based on the desired distance S1 between a first and second resonators;

b. determining a desired secondary coupling F2 in order to arrive at the total desired coupling between the first and second resonators; and c. determining the distances and lengths of the coupling strip from the first and second resonators to achieve the determined secondary coupling F2, where F2 is a function of S2*a*, S2*b*, L2*a* and L2*b*, and S2*a* is defined as the distance between the coupling strip and the first resonator, L2*a* is the length of the coupling strip which lies adjacent the first resonator, S2*b* is the distance between the coupling strip and the second resonator, and L2*b* is the length of the coupling strip which lies adjacent the second resonator, the primary coupling F1, wherein the total coupling between the first resonator and the second resonator, F, is defined by:

$$F=F1(S1)+F2(S2a, S2b, L2a, L2b).$$

13. The method of claim 12, further comprising the step of locating at least one non-adjacent resonator device and a coupling strip between the first resonator and the at least one non-adjacent resonator device.

14. A resonator apparatus, for use in filters for an electrical signal, comprising:

a. a first resonator device, having a first end and a second end;

b. a second resonator device;

c. a coupling strip which couples the second end to the second resonator, the second end being physically unconnected from the coupling strip; and d. wherein the first end and the second end are arranged and configured to lie on the same side of the first resonator and proximate the second resonator, and wherein a first distance S1 of the first end from the second resonator creates a primary coupling F1 between the first and second resonators, and a second distance and a length of the second end creates a secondary coupling F2 between the first and second resonators, whereby the overall distance of the first and second resonators from one another is optimized by independently controlling the primary or secondary coupling.

15. The resonator apparatus of claim 14, wherein the primary coupling F1 is a function of the first distance S1 between the first and second resonators, and the secondary coupling F2 is a function of S2*a*, S2*b*, L2*a* and L2*b* where S2*a* is the distance between the coupling strip and the first resonator and L2*a* is the length of the coupling strip which lies adjacent the first resonator, S2*b* is the distance between the coupling strip and the second resonator and L2*b* is the length of the coupling strip which lies adjacent the second resonator, wherein the total coupling between the first resonator and the second resonator, F, is defined by:

$$F=F1(S1)+F2(S2a, S2b, L2a, L2b).$$

16. The resonator apparatus of claim 14, wherein the primary coupling can be either capacitive or inductive and the secondary coupling can be either capacitive or inductive.

17. The resonator apparatus of claim 14, wherein the primary coupling can be either capacitive or inductive.

18. The resonator apparatus of claim 14, wherein the secondary coupling can be either capacitive or inductive.

19. The resonator apparatus of claim 14, further comprising at least one non-adjacent resonator device and a coupling strip between the first resonator and the at least one non-adjacent resonator device.

20. The resonator apparatus of claim 14, wherein the first and second resonator and the coupling strip are all located on a common planar surface of a circuit substrate.

* * * * *